US007905773B2

(12) United States Patent
Moffett, VI et al.

(10) Patent No.: US 7,905,773 B2
(45) **Date of Patent: *Mar. 15, 2011**

(54) GAMING DEVICE

(76) Inventors: Nicholas D. Moffett, VI, Spearfish, SD (US); Emily S. Nelson, Sioux Falls, SD (US)

( * ) Notice: Subject to any disclaimer, the term of this patent is extended or adjusted under 35 U.S.C. 154(b) by 803 days.

This patent is subject to a terminal disclaimer.

(21) Appl. No.: 11/860,526

(22) Filed: Sep. 24, 2007

(65) Prior Publication Data

US 2008/0009331 A1 Jan. 10, 2008

Related U.S. Application Data

(63) Continuation-in-part of application No. 11/391,145, filed on Mar. 28, 2006, now Pat. No. 7,281,712, which is a continuation of application No. 11/297,539, filed on Dec. 8, 2005, now Pat. No. 7,073,790, which is a continuation of application No. 10/800,966, filed on Mar. 16, 2004, now Pat. No. 7,070,183, which is a continuation-in-part of application No. 09/988,794, filed on Nov. 20, 2001, now abandoned.

(60) Provisional application No. 60/251,427, filed on Dec. 6, 2000.

(51) Int. Cl.
*A63F 7/02* (2006.01)

(52) U.S. Cl. ..... 463/20; 463/1; 463/16; 273/118 A; 273/119 A; 273/138.1

(58) Field of Classification Search ..... 273/118 R, 273/118 A, 118 D, 119 R, 119 A, 121 R, 273/121 A, 138.1, 143 R, 109; 463/1, 16, 463/17, 20

See application file for complete search history.

(56) References Cited

U.S. PATENT DOCUMENTS

| | | | |
|---|---|---|---|
| 3,853,318 | A | 12/1974 | Cagan |
| D251,515 | S | 4/1979 | Richter et al. |
| D260,409 | S | 8/1981 | Tanaka et al. |
| 4,508,345 | A | 4/1985 | Okada |
| 4,518,098 | A | 5/1985 | Fleischer |
| 5,010,995 | A | 4/1991 | Okada |
| D337,790 | S | 7/1993 | Gottlieb et al. |
| 5,342,049 | A | 8/1994 | Wichinsky et al. |
| 5,630,586 | A | 5/1997 | Lowden |

(Continued)

FOREIGN PATENT DOCUMENTS

| | | |
|---|---|---|
| GB | 2083936 | 3/1982 |

(Continued)

*Primary Examiner* — Raleigh W. Chiu

(74) *Attorney, Agent, or Firm* — Harness, Dickey & Pierce, P.L.C.

(57) ABSTRACT

Exemplary embodiments for playing a game having a slot mode and a pinball mode generally include activating the slot mode to display different combinations of symbols and create a slot credit score, activating the pinball mode to play a pinball game and create a pinball credit score, and adding the pinball credit score to the slot credit score when the game switches from the pinball mode to the slot mode. The pinball game may include at least two flippers for operation by a player. The slot mode may switch to the pinball mode upon display of a combination of symbols including a pinball symbol. Machine-readable media may embody instructions for causing one or more machines to perform operations related to the game. Systems for playing the game may include an input, a processor that executes instructions in response to an input, and a display.

21 Claims, 6 Drawing Sheets

U.S. PATENT DOCUMENTS

| | | | | |
|---|---|---|---|---|
| 5,882,261 | A | 3/1999 | Adams | |
| 5,997,400 | A | 12/1999 | Seelig et al. | |
| D419,201 | S | 1/2000 | de Haas | |
| 6,047,963 | A | 4/2000 | Pierce et al. | |
| 6,053,813 | A | 4/2000 | Mathis | |
| 6,089,976 | A | 7/2000 | Schneider et al. | |
| 6,089,978 | A | 7/2000 | Adams | |
| 6,203,008 | B1 | 3/2001 | Krise et al. | |
| 6,709,332 | B2 | 3/2004 | Adams | |
| 7,070,183 | B2 | 7/2006 | Moffett et al. | |
| 7,073,790 | B2 | 7/2006 | Moffett et al. | |
| 7,281,712 | B2 * | 10/2007 | Moffett et al. | 273/118 R |
| 2002/0066996 | A1 | 6/2002 | Nelson et al. | |

FOREIGN PATENT DOCUMENTS

| | | |
|---|---|---|
| GB | 2182186 | 5/1987 |
| GB | 2201821 | 9/1988 |

* cited by examiner

GAMING DEVICE

CROSS-REFERENCE TO RELATED APPLICATIONS

This application is a continuation-in-part application of pending U.S. patent application Ser. No. 11/391,145 entitled Gaming Device and filed Mar. 28, 2006, which is a continuation application of U.S. patent application Ser. No. 11/297,539 (now U.S. Pat. No. 7,073,790) entitled Gaming Device and filed Dec. 8, 2005, which is a continuation application of U.S. patent application Ser. No. 10/800,966 (now U.S. Pat. No. 7,070,183) entitled Gaming Device and filed Mar. 16, 2004. U.S. patent application Ser. No. 10/800,966 is a continuation-in-part application of U.S. patent application Ser. No. 09/988,794, entitled Gaming Device and Method and filed Nov. 20, 2001, now abandoned. U.S. patent application Ser. No. 09/988,794 claims the benefit of U.S. Prov. Pat. App. No. 60/251,427 entitled Gaming Device and filed Dec. 6, 2000. The entire disclosures of each of these applications are hereby incorporated by reference.

FIELD

The present disclosure is generally directed toward gaming devices and methods for gaming. More specifically, the present disclosure is generally directed toward pinball-slot machine combination games, methods for playing the games, and media-embodied instructions for the games.

BACKGROUND

The statements in this section merely provide background information related to the present disclosure and may not constitute prior art.

"Gaming" and/or the participation of people in games, including wagering games, is probably as old as civilization and is worldwide in scope. In the last half of the twentieth century, the proliferation of gaming in the United States alone is evidence that games of chance and/or skill are still enjoyed by large numbers of people.

SUMMARY

Exemplary embodiments of the present disclosure are generally directed toward methods for playing games having slot modes and pinball modes. For example, in one exemplary embodiment, a method for playing a game having at least a slot mode and a pinball mode generally comprises activating the slot mode of the game to thereby allow the game to display at least one combination of symbols and to create a slot credit score, allowing activation of the pinball mode of the game to thereby allow a player to play a pinball game and create a pinball credit score, switching between the pinball mode and the slot mode, and adding the pinball credit score to the slot credit score.

In another exemplary embodiment, a method for playing a game having at least a slot mode and a pinball mode generally comprises activating the slot mode of the game to thereby allow the game to display at least one combination of symbols and activating the pinball mode of the game upon display of a combination of symbols including a pinball symbol, wherein the pinball mode includes a pinball game having at least two flippers.

Other exemplary embodiments of the present disclosure are generally directed toward machine-readable media embodying instructions for causing one or more machines to perform operations related to games having slot modes and pinball modes. In one exemplary embodiment, the machine-readable media embody instructions for causing one ore more machines to perform operations generally comprising activating the slot mode of the game to thereby allow the game to display at least one combination of symbols and to create a slot credit score, allowing activation of the pinball mode of the game to thereby allow a player to play a pinball game and create a pinball credit score, switching between the pinball mode and the slot mode, and adding the pinball credit score to the slot credit score.

In another exemplary embodiment, machine-readable media embody instructions for causing one ore more machines to perform operations generally comprising activating the slot mode of the game to thereby allow the game to display at least one combination of symbols, activating the pinball mode of the game to thereby allow a player to play a pinball game including at least two flippers, and switching from the slot mode to the pinball mode upon display of a combination of symbols including a pinball symbol.

Still other exemplary embodiments of the present disclosure are generally directed toward systems for playing games including slot modes and pinball modes. In one exemplary embodiment, a system for playing a game including at least a slot mode and a pinball mode generally comprises an input to receive a player input to play a game having at least a slot mode and a pinball mode. A processor executes instructions in response to at least one player input. The instructions include instructions for causing one or more machines to perform operations, including activating the slot mode, displaying at least one symbol in the slot mode, creating a slot score, activating the pinball mode, creating a pinball score, and adding the pinball score and the slot score when switching from one of the slot mode and the pinball mode to the other of the slot mode and the pinball mode. A display can display the at least one symbol and at least one of the slot score and the pinball score.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
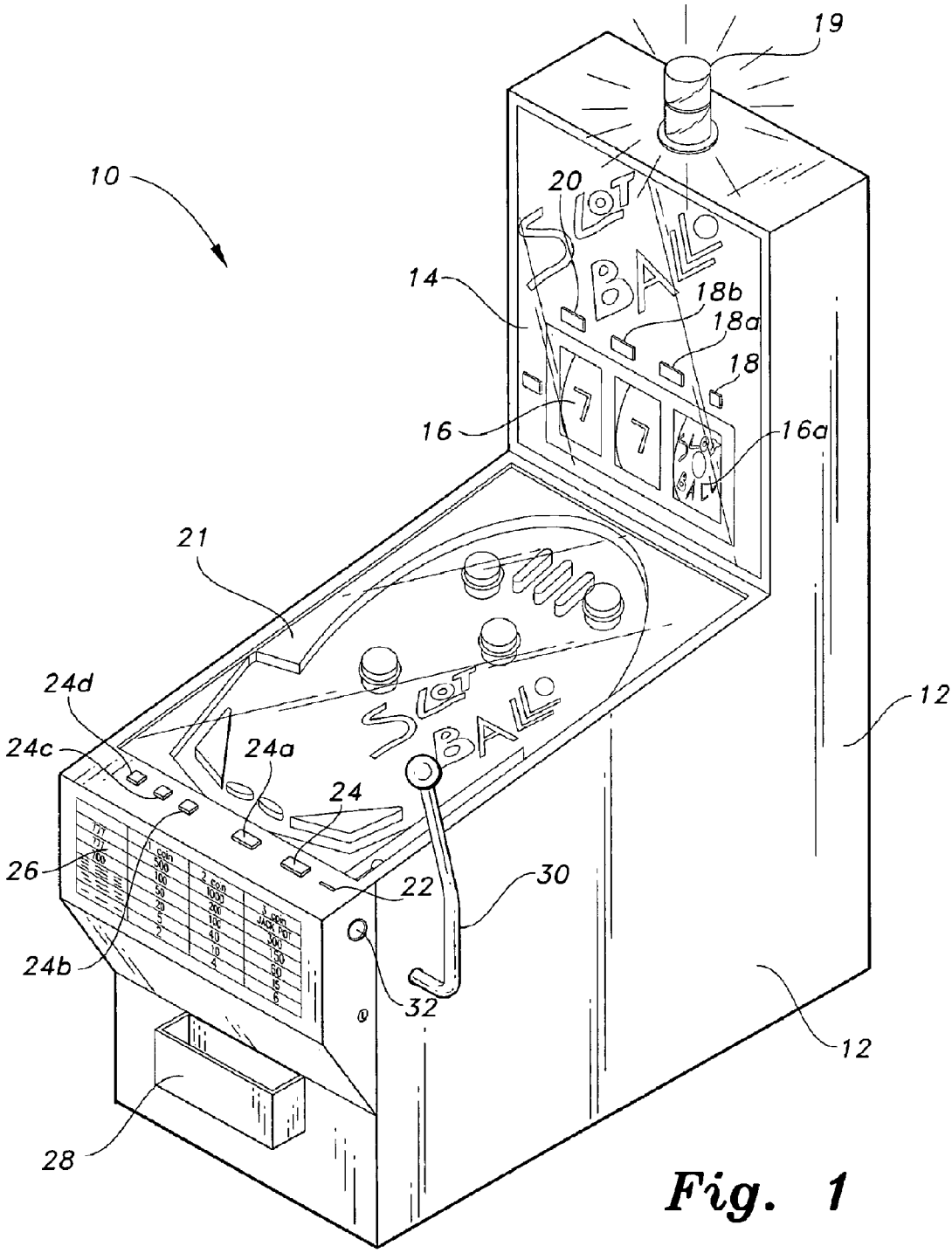
FIG. 1 is a perspective view of a gaming device according to one exemplary embodiment.
Figure 2:
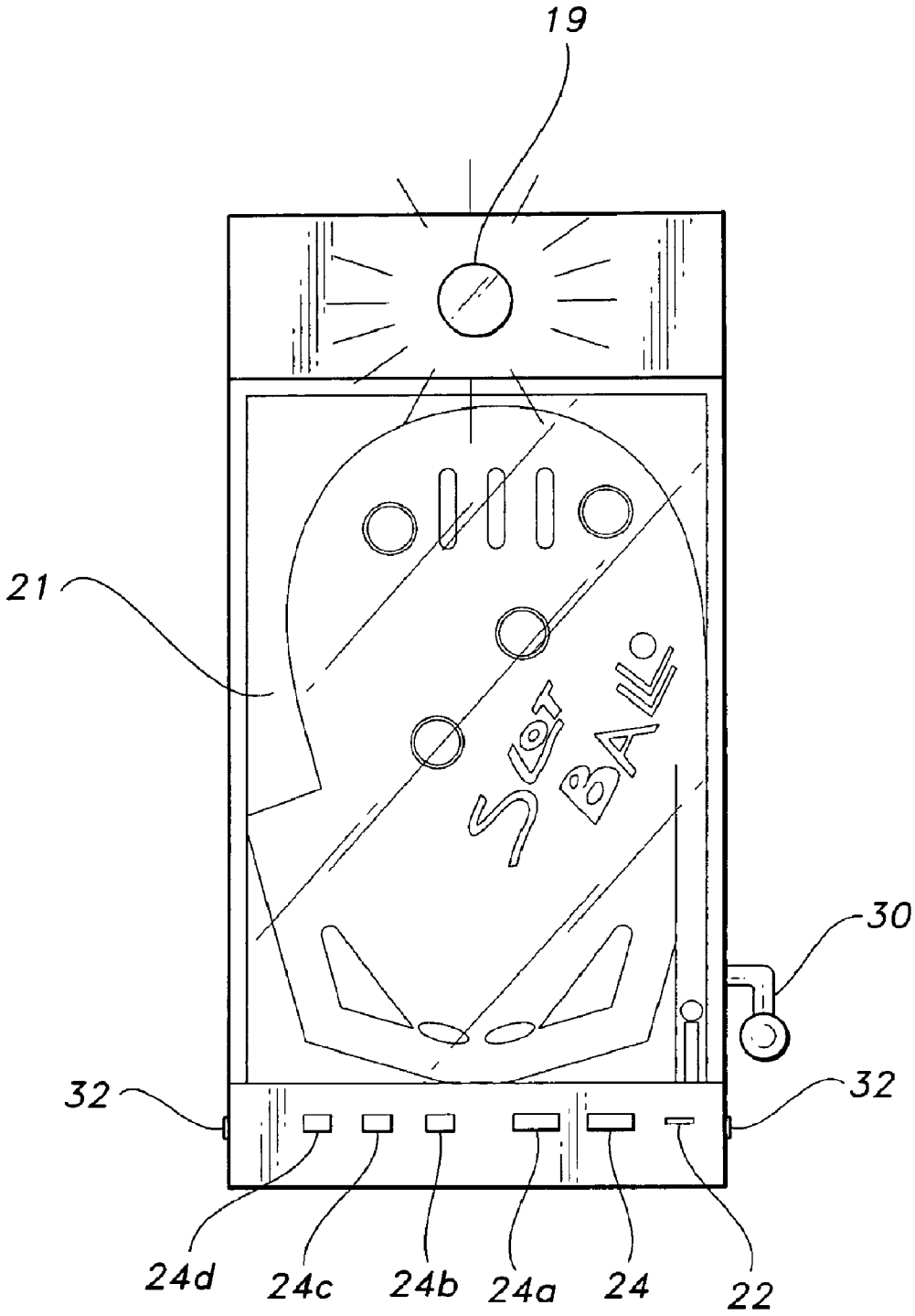
FIG. 2 is a top view of the gaming device.
Figure 3:
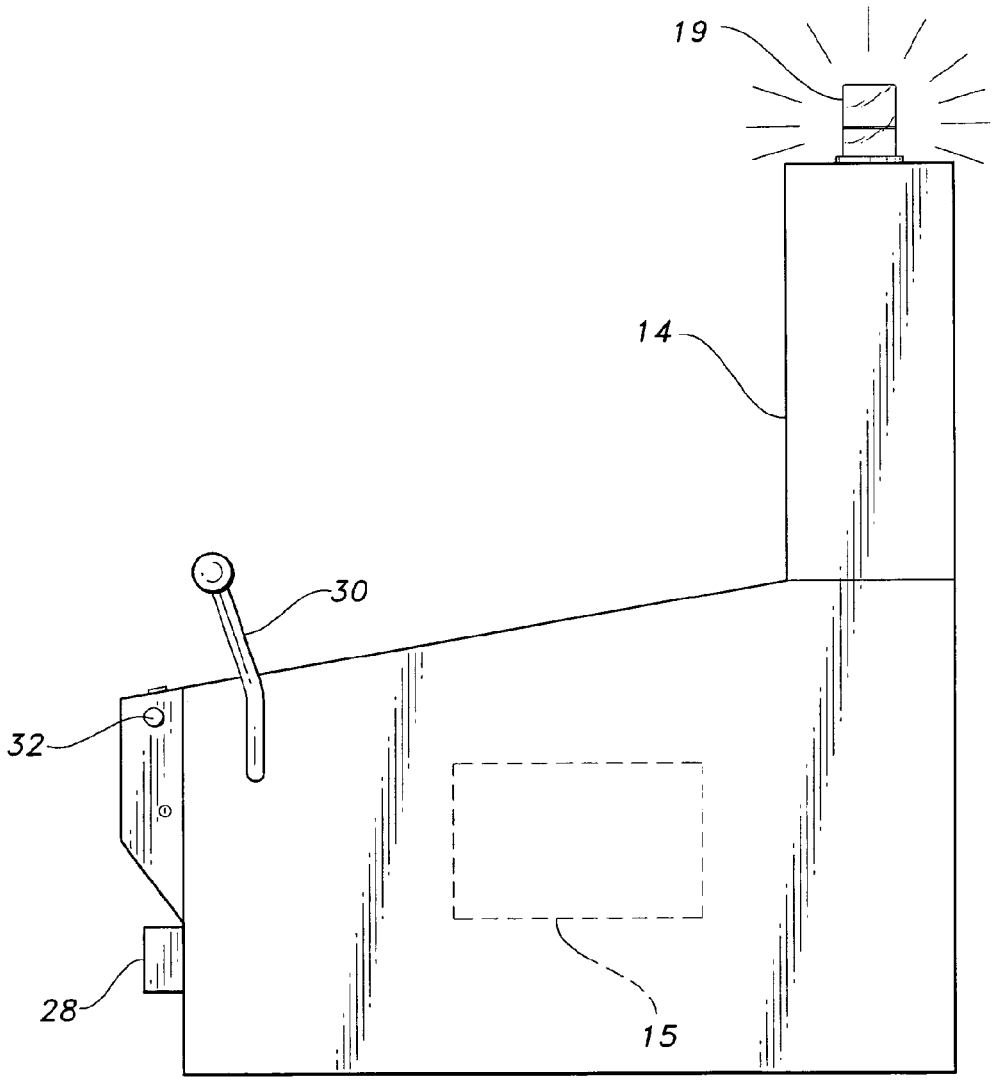
FIG. 3 is a side view of the gaming device.

The gaming apparatus of the present disclosure is generally indicated at 10 as illustrated in FIGS. 1-3. Apparatus 10 includes walls 12 which support and house conventional mechanical and electromechanical mechanisms 15 for operating a combination slot-pinball machine game. Walls 12 are designed to form a solid base to prevent the apparatus from being easily tilted. Although walls are illustrated as the support means, sturdy legs (or the like) could be utilized if desired.

The upper section 14 of the gaming apparatus 10 is designed to appear and function as a slot machine and includes slot reels 16 and indicator lights 18, 18*a*, 18*b*. Indicator 18 gives a reading for credits played; 18*a* indicates credits won in the pinball mode; 18*b* indicates total credits available. Indicator light 20 is the winner paid indicator. Slot reels 16 exhibit the standard pay line and slot icons (sevens, bars, cherries, etc.). The illustrated gaming apparatus 10 may, however, require at least one reel to employ an icon with words, for example "slot ball," inscribed thereon as shown at 16*a*. A light 19 is adapted to flash to indicate either when a machine error occurs or when a player has hit the jackpot. In other exemplary embodiments, gaming apparatus may include slot machines with icons displayed electronically on a display, monitor, screen, etc.

The lower section 21 of the apparatus is designed to appear and function as a pinball machine. Lower section 21 includes a control panel that incorporates the following functions. A coin slot 22 is provided for inserting coins or casino tokens to initiate the apparatus game mechanisms. Push button 24 is utilized to place a maximum credit bet. Push button 24*a* may be used to activate the slot reels. Button 24*b* is employed when a player wishes to input the amount of credits bet (from one to the maximum amount). Button 24*c* is used when a player decides to terminate play and wishes to cash out. Button 24*d* is a service button. For convenience, a pay scale 26 is inscribed on the front wall of the apparatus. A tray 28 for catching the player's winnings is positioned immediately beneath the pay scale. A handle (or lever, etc.) 30 may be employed to activate the slot reels or launch the pinball when in pinball mode. Buttons 32 functions to move the pinball flippers (not shown) as is conventional in the art.

To initiate play, the player inserts coins or gaming tokens into coin slot 22. The player may bet any desired amount. However, the player may not qualify for the slot jackpot and the "slot ball" bonus round if maximum credits are not bet. Handle 30, button 24 or button 24*a* is then manipulated to start slot reels 16. If the "slot ball" icon 16*a* appears on the pay line and the maximum amount of credits have been bet, the machine will automatically switch into the pinball mode. The player will then be able to win extra credits playing pinball. Once the pinball mode is activated, the machine will automatically place a pinball into the launch position. Handle 30 is employed to launch the pinball. As in ordinary pinball games, the player manipulates the pinball by pressing buttons 32, which buttons cause the flippers (not shown) to direct the pinball to strike credit adding or credit subtracting sensors. When the pinball goes out of play, the game reverts to the slot mode. The player has a choice of continuing to play by repeating the above process or to cash out.

Figure 4:
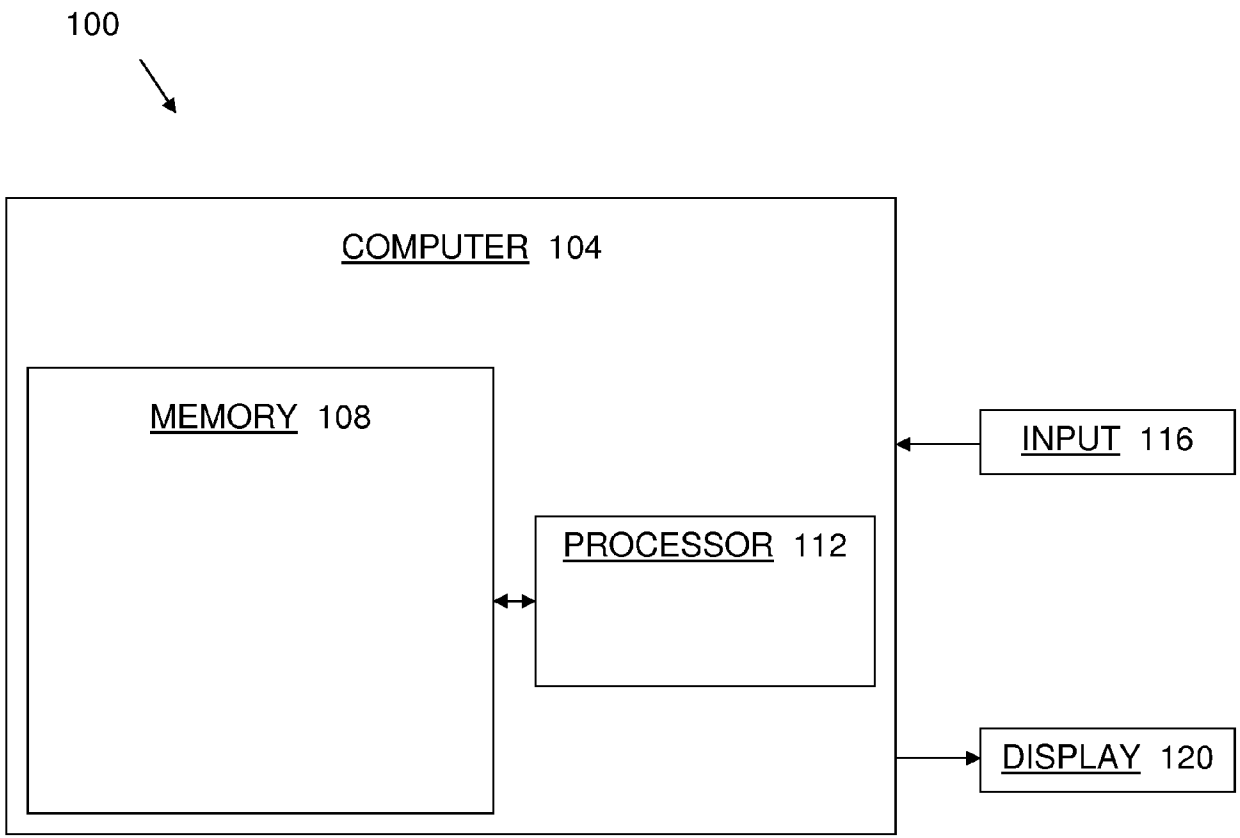
FIG. 4 is a block diagram of an exemplary embodiment of a system capable of being used to play a game having a slot mode and a pinball mode.

With additional reference now to FIG. 4, an exemplary embodiment of a system 100 capable of being used to play a game having a slot mode and a pinball mode is shown. As will be described in more detail hereinafter, the system 100 may allow for a player to activate the slot mode of the game to display at least one combination of symbols (e.g., 16, etc.) and create a slot credit score (e.g., 18*b*, etc.). The system 100 may then allow the player to activate the pinball mode of the game to play a pinball game and create a pinball credit score (e.g., 18*a*, etc.). The game may switch from the slot mode to the pinball mode upon display of a combination of symbols (e.g., 16, etc.) including a pinball symbol (e.g., 16*a*, etc.). When the pinball mode ends, the game may switch back to the slot mode, at which time the pinball credit score (e.g., 18*a*, etc.) may be added to the slot credit score (e.g., 18*b*, etc.).

As shown in FIG. 4, the illustrated system 100 generally includes a computer 104 having a memory 108 and a processor 112 suitable for executing functions of the computer 104. The computer 104 may include, for example, a desktop computer, a laptop computer, a hand-held computer, a minicomputer, a mainframe computer, a personal digital assistant (PDA), a cell phone, a programmable electronic device, a gaming device/apparatus, or any other suitable computing and/or electronic device within the scope of the present disclosure. And, the processor 112 may include, for example, a central processing unit (CPU), a micro-controller, a microprocessor, a programmable logic device, an application-specific integrated circuit (ASIC), or any other suitable device capable of executing functions of the computer 104. As an example, the system 100 may be implemented and/or associated with the gaming apparatus 10 previously described and illustrated in FIGS. 1-3.

The system 100 may also include a variety of media (e.g., machine-readable media, including computer storage media, communication media, etc.) suitable for storing and/or communicating to the computer 104, for example, instructions and/or items such as machine instructions, game instructions, machine executables, program code, software packages, programs, routines, subroutines, algorithms, information, data, files, databases, applications, etc. In the illustrated system 100, the computer memory 108 may include machine-readable media such as read-only memory (ROM) and random access memory (RAM). And, instructions for playing the game having the slot mode and the pinball mode may be embodied on and/or associated with the computer memory 108 for access by the player. Here, the processor 112 may execute instructions for playing the game.

In some exemplary systems, the computer 104 may also include other removable and/or non-removable, volatile and/or nonvolatile machine-readable media. For example, the computer 104 may include a hard disk drive that reads from and/or writes to non-removable, nonvolatile magnetic media; a magnetic disk drive that reads from and/or writes to a removable, nonvolatile magnetic disk; an optical disk drive that reads from and/or writes to a removable, nonvolatile optical disk (e.g., a compact disk (CD), digital versatile disk (DVD), etc.); suitable combinations thereof; etc. Other suitable removable and/or non-removable, volatile and/or nonvolatile machine-readable media may also include floppy disks, magnetic tape cassettes, flash memory cards, digital video tape, solid state RAM, solid state ROM, video memory (VRAM), a combination thereof, etc. In these exemplary embodiments, instructions for playing the game having the slot mode and the pinball mode may be embodied on and/or associated with one or more of the removable and/or non-removable, volatile and/or nonvolatile machine-readable media.

The system 100 further includes an input 116 and a display 120 operatively coupled (e.g., via wired connections, wireless connections, etc.) to the computer 104. During an exemplary operation of the system 100, the input 116 receives a player input to play the game having the slot mode and the pinball mode and allows the player to enter/supply instructions, commands and/or information into the computer 104 to selectively access the instructions for playing the game. The processor 112 may then execute the instructions in response to the player's input. The display 120 allows the player to view operation and/or outcome of the instructions. For example, the display 120 can display combinations of symbols in the slot mode of the game, the slot credit score, the pinball credit score, etc. Together, the input 116 and the display 120 allow the player to interact with the system 100 to play the game. The input 116 may include, for example, a keyboard, a keypad, a mouse, a trackball, a touchpad, a pointing device, a microphone, a voice-recognition device, a touch-recognition device, a joystick, a handle, a lever, a game pad, a game controller, a scanner, a satellite dish, a combination thereof, etc. The display 120 may include, for example, a monitor or other display device to allow the player to view operation and/or outcome of the instructions. Some exemplary systems may further include peripheral output devices such as speakers, a printer, etc. operatively coupled (e.g., via wired connections, wireless connections, etc.) to the computer 104.

In the illustrated system 100, the input 116 and the display 120 are separate devices. In other exemplary systems, the input 116 and the display 120 may be integrally formed as a single device. For example, the integrally formed device may include a touch-recognition display. The touch-recognition display may allow the player to enter commands and information into the computer 104 to selectively access the instructions for playing the game as well as view the operation and/or outcome of the instructions.

The instructions described herein can be conventionally programmed using any of a wide range of suitable programming languages. It is also to be understood that the instructions described herein can include one or more functions, routines, sub-functions, and subroutines, and need not be combined in a single package but may instead be embodied in separate components. In addition, the instructions may be a stand-alone application, or may be a plug-in module for an existing application and/or operating system. Alternatively, the instructions may be integrated into an application or operating system. In yet another embodiment, the instructions may reside at one or more network devices (not shown), such as an administrator terminal, a server, etc.

Figure 5:
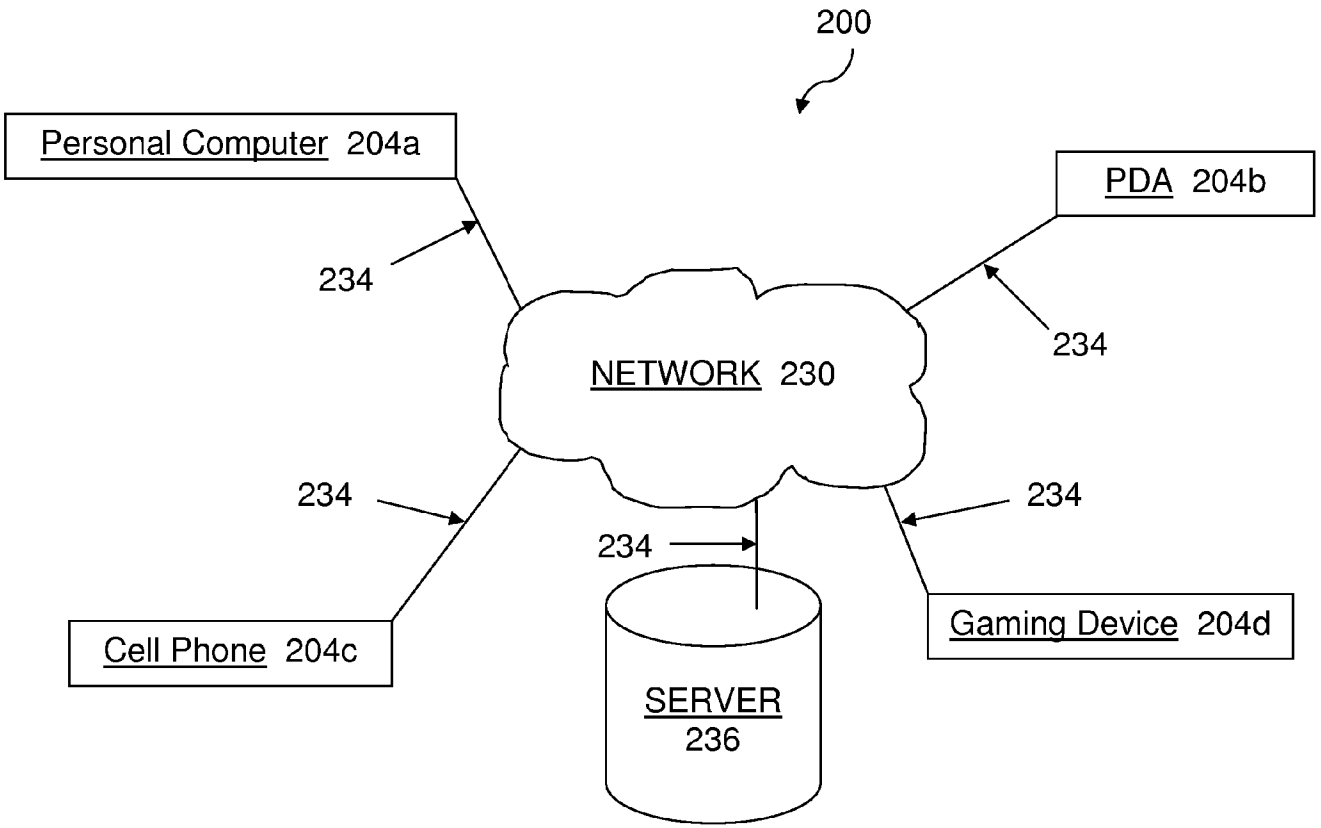
FIG. 5 is a plan view of another exemplary embodiment of a system capable of being used to play a game having a slot mode and a pinball mode.

With reference to FIG. 5, another exemplary embodiment of a system 200 is shown in which instructions for playing a game having a slot mode and a pinball mode may be accessed using a network 230. The network 230 may be connected, for example, to one or more remote computers (e.g., personal computer 204*a*; PDA 204*b*; cell phone 204*c*; gaming device 204*d*; etc.) by communication links 234. The network 230 may also be connected to a server 236 (e.g., a remote server, a gaming server, etc.) by a communication link 234. The communication links 234 can be wired and/or wireless communication links.

The network 230 may include a public network connection (e.g., Internet, etc.), an Intranet connection, a virtual private network connection, a World Wide Web network connection, a private network connection, etc. In addition, the network 230 can be any size depending on the particular implementation, including, for example, a local area network (LAN), a wide area network (WAN), a metropolitan area network (MAN), etc. In one exemplary embodiment, the instructions can be provided through a webpage or website accessible through an Internet. In another exemplary embodiment, other network addresses may provide access to the instructions.

Figure 6:
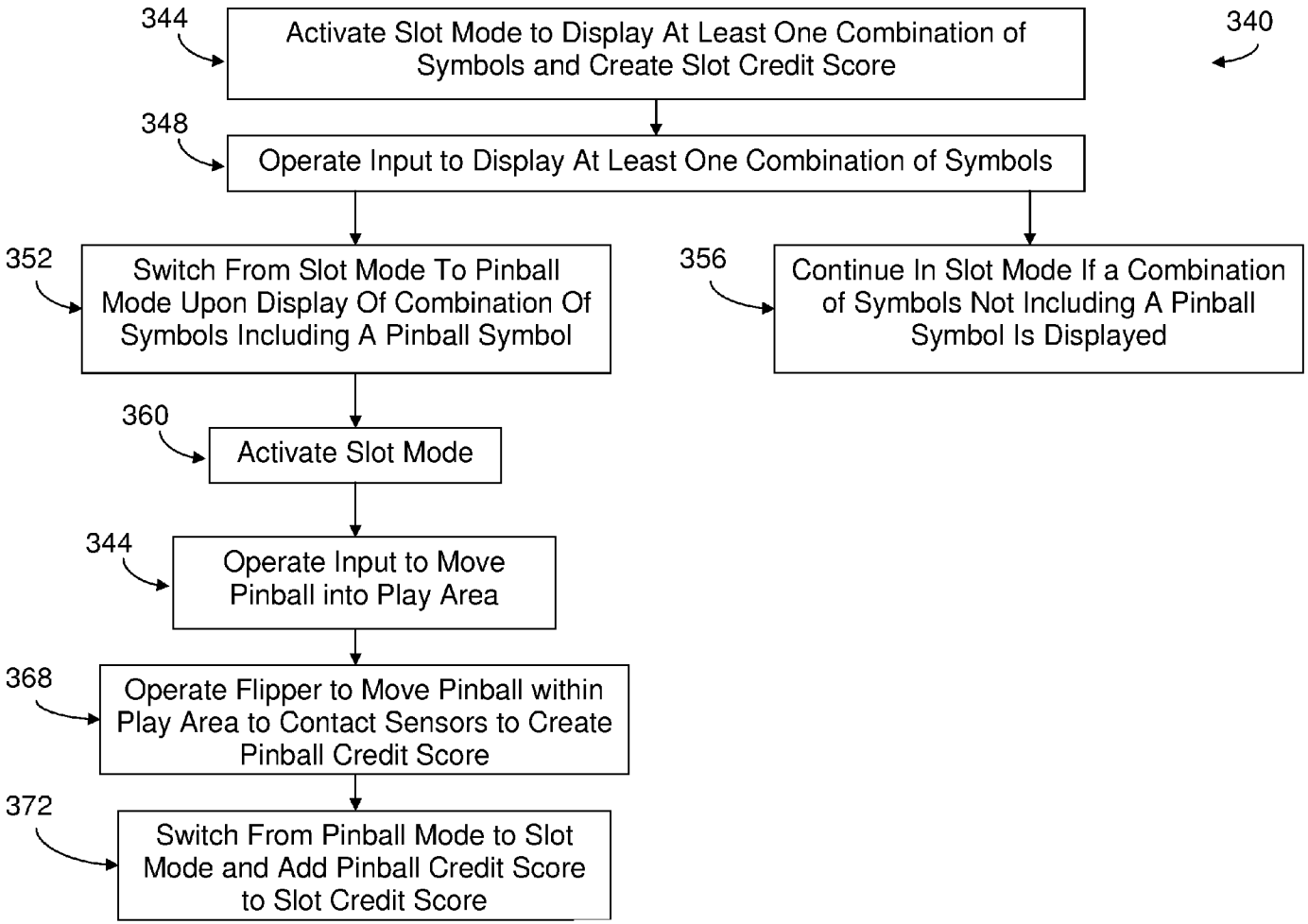
FIG. 6 is a schematic view of an exemplary method for playing a game having a slot mode and a pinball mode.

FIG. 6 schematically illustrates an exemplary method 340 implemented by, for example, a system (e.g., 100, 200, etc.) for playing a game having a slot mode and a pinball mode. As shown at process 344, in this exemplary method 340 the system (e.g., 100, 200, etc.) may be operated by a player to allow the player to activate the slot mode of the game to display at least one combination of symbols (e.g., 16, etc.) and create a slot credit score (e.g., 18*b*, etc.). Obtaining one or more specific combinations of symbols (e.g., 16, etc.) may increase the player's slot credit score (e.g., 18*b*, etc.); obtaining one or more other combinations of symbols (e.g., 16, etc.) may decrease the player's slot credit score (e.g., 18*b*, etc.). The player may activate the slot mode by operating an input (e.g., input 116, etc.) to display the at least one combination of symbols (e.g., 16, etc.) and create the slot credit score (e.g., 18*b*, etc.) (process 348). In one exemplary embodiment, the player may activate the slot mode by operating a handle or lever (e.g., 30, etc.). In another exemplary embodiment, the player may activate the slot mode by using/pressing a button. In still another exemplary embodiment, the player may activate the slot mode by touching the display 120. As shown at process 352, the game may switch from the slot mode to the pinball mode upon display of a combination of symbols (e.g., 16, etc.) including a pinball symbol (e.g., 16*a*, etc.). And the game may continue or remain in the slot mode if a combination of symbols (e.g., 16, etc.) not including the pinball symbol (e.g., 16*a*, etc.) is displayed (process 356).

When the game switches from the slot mode to the pinball mode (process 352), the player may activate the pinball mode to play a pinball game and create a pinball credit score (e.g., 18*a*, etc.) (process 360). Here, the slot mode may deactivate, or the slot mode may remain activated within the scope of the present disclosure. The player may activate the pinball mode by operating an input (e.g., 116, etc.) to move the pinball into a play area of the pinball game (process 364). In one exemplary embodiment, the player may activate the pinball mode by operating a handle or lever (e.g., 30, etc.). In another exemplary embodiment, the player may activate the pinball mode by touching the display 120. The player may then operate one or more flippers (e.g., using the input 116, etc.) to move the pinball within the play area into contact with at least one or more credit adding sensors and/or credit subtracting sensors to create the pinball credit score (e.g., 18*a*, etc.) (process 368). The pinball game may continue until the pinball moves out of the play area (e.g., by entering or falling through an opening (not shown) in the play area, etc.), at which time the game may switch (e.g., automatically, etc.) from the pinball mode to the slot mode, and the pinball credit score (e.g., 18*a*, etc.) may be added to the slot credit score (e.g., 18*b*, etc.) (process 372). Here, the pinball mode may deactivate, or the pinball mode may remain activated within the scope of the present disclosure. The slot mode may then be activated (if previously deactivated), and play may continue in the slot mode of the game. Or the player may terminate play and, for example, collect a monetary payment, award, prize, etc. based on the acquired slot credit score (e.g., 18*b*, etc.) and/or pinball credit score (e.g., 18*a*, etc.). A monetary payment, for example, can be calculated as a function of one or more of the slot credit score (e.g., 18*b*, etc.), pinball credit score (e.g., 18*a*, etc.), or summation thereof.

In other exemplary embodiments, the game having the slot mode and the pinball mode may include one or more additional modes for playing one ore more additional games, including, for example, card games (e.g., blackjack, poker, etc.), video games, etc. In still other exemplary embodiments of the game having the slot mode and the pinball mode, the pinball credit score may not be added to the slot credit score when the pinball game ends; the pinball credit score may be added to the slot credit score before and/or after the pinball game ends; etc. Alternatively, the slot credit score may be added to the pinball credit score at any time.

When introducing elements of the present disclosure, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, systems, and methods without departing from the scope of the present disclosure, it is intended that all matter contained in the above description and shown in the accompanying drawings shall be interpreted as illustrative and not in a limiting sense. It is also understood that the present disclosure is not limited to the embodiments described above, but encompasses any and all embodiments within the scope of the following claims.

What is claimed is:

1. A method for playing a game having at least a slot mode and a pinball mode, the method comprising:

activating the slot mode of the game to thereby allow the game to display at least one combination of symbols and to create a slot credit score;

allowing activation of the pinball mode of the game to thereby allow a player to play a pinball game and create a pinball credit score;

switching between the pinball mode and the slot mode;

adding the pinball credit score to the slot credit score.

2. The method of claim 1 further comprising automatically switching from the slot mode to the pinball mode upon display of a combination of symbols including a pinball symbol.

3. The method of claim 2 wherein the game continues in the slot mode if a combination of symbols not including the pinball symbol is displayed.

4. The method of claim 1 wherein activation of the pinball mode of the game includes moving a pinball within a play area of the pinball game to contact at least one or more of credit adding sensors and credit subtracting sensors to create the pinball credit score.

5. The method of claim 4 wherein moving the pinball within the play area includes contacting the pinball with a flipper.

6. The method of claim 1 further comprising adding the pinball credit score to the slot credit score when the pinball game ends and the game switches from the pinball mode to the slot mode.

7. A method for playing a game having at least a slot mode and a pinball mode, the method comprising:

activating the slot mode of the game to thereby allow the game to display at least one combination of symbols;

activating the pinball mode of the game upon display of a combination of symbols including a pinball symbol;

wherein the pinball mode includes a pinball game having at least two flippers.

8. The method of claim 7 wherein activating the pinball mode of the game includes operating the at least two flippers to move a pinball within a play area of the pinball game to create a pinball credit score that is added to a slot credit score when the game switches from the pinball mode to the slot mode.

9. The method of claim 7 wherein activating the slot mode includes operating a lever to display at least one combination of symbols, and wherein activating the pinball mode includes operating said lever to cause a pinball to enter a play area of the pinball game.

10. The method of claim 7 further comprising continuing operation of the game in the slot mode if a combination of symbols not including the pinball symbol is displayed.

11. One or more machine-readable media embodying instructions for causing one or more machines to perform operations comprising:

activating the slot mode of the game to thereby allow the game to display at least one combination of symbols and to create a slot credit score;

allowing activation of the pinball mode of the game to thereby allow a player to play a pinball game and create a pinball credit score;

switching between the pinball mode and the slot mode;

adding the pinball credit score to the slot credit score.

12. The machine-readable media of claim 11 embodying instructions for causing the one or more machines to perform operations further comprising switching from the slot mode to the pinball mode upon display of a combination of symbols including a pinball symbol.

13. The machine-readable media of claim 11 embodying instructions for causing the one or more machines to perform operations further comprising moving a pinball within a play area of the pinball game to contact at least one or more of credit adding sensors and credit subtracting sensors to create the pinball credit score.

14. One or more machine-readable media embodying instructions for causing one or more machines to perform operations comprising:

activating the slot mode of the game to thereby allow the game to display at least one combination of symbols;

activating the pinball mode of the game to thereby allow a player to play a pinball game including at least two flippers;

switching from the slot mode to the pinball mode upon display of a combination of symbols including a pinball symbol.

15. The machine-readable media of claim 14 embodying instructions for causing the one or more machines to perform operations further comprising allowing operation of the at least two flippers to move a pinball within a play area of the pinball game to create a pinball credit score that is added to a slot credit score when the game switches from the pinball mode to the slot mode.

16. The machine-readable media of claim 14 embodying instructions for causing the one or more machines to perform operations further comprising allowing operation of a lever to cause the game to display at least one combination of symbols in the slot mode, and allowing operation of said lever to at least begin playing the pinball game in the pinball mode.

17. A system for playing a game including at least a slot mode and a pinball mode, the system comprising:

an input to receive a player input to play a game having at least a slot mode and a pinball mode;

a processor to execute instructions in response to at least one player input, the instructions including instructions for causing one or more machines to perform operations including activating the slot mode, displaying at least one symbol in the slot mode, creating a slot score, activating the pinball mode, creating a pinball score, and adding the pinball score and the slot score when switching from one of the slot mode and the pinball mode to the other of the slot mode and the pinball mode; and a display to display the at least one symbol and at least one of the slot score and the pinball score.

18. The system of claim 17 wherein the input and display are included in a touch recognition display.

19. The system of claim 17 wherein the instructions are stored in a memory associated with the processor.

20. The system of claim 17 wherein the instructions are provided to the processor via a network connection.

21. The system of claim 20 wherein the network connection includes the Internet.

* * * * *